US005915872A

United States Patent [19]

Machida et al.

[11] Patent Number: 5,915,872

[45] Date of Patent: Jun. 29, 1999

[54] ERASING LIQUID PEN

[75] Inventors: Minoru Machida; Norio Moriyama, both of Isesaki; Michiaki Kuramoto, Shinagawa-ku, all of Japan

[73] Assignee: Kabushiki Kaisha Pilot, Tokyo-to, Japan

[21] Appl. No.: 08/981,258

[22] PCT Filed: Mar. 11, 1997

[86] PCT No.: PCT/JP97/00758

§ 371 Date: Mar. 2, 1998

§ 102(e) Date: Mar. 2, 1998

[87] PCT Pub. No.: WO97/39901

PCT Pub. Date: Oct. 30, 1997

[30] Foreign Application Priority Data

Apr. 25, 1996 [JP] Japan ..... 8-128982

[51] Int. Cl.[6] ..... B43K 5/00; B43K 7/08

[52] U.S. Cl. ..... 401/251; 401/209; 401/213; 401/214; 401/216

[58] Field of Search ..... 401/213, 214, 401/216, 209, 251, 199

[56] References Cited

U.S. PATENT DOCUMENTS

| | | | |
|---|---|---|---|
| 4,077,726 | 3/1978 | Hechtle | 401/209 |
| 4,712,937 | 12/1987 | Schmidt et al. | 401/209 |
| 5,468,082 | 11/1995 | Hori | 401/214 |
| 5,482,393 | 1/1996 | Sekiguchi et al. | 401/214 |

FOREIGN PATENT DOCUMENTS

| | | |
|---|---|---|
| 6-170320 | 6/1994 | Japan . |
| 7-31170 | 6/1995 | Japan . |

*Primary Examiner*—Henry J. Recla
*Assistant Examiner*—Tuan N. Nguyen
*Attorney, Agent, or Firm*—Wenderoth, Lind & Ponack, L.L.P.

[57] ABSTRACT

A correction pen has a joining mechanism for joining together a front end portion (11) of a barrel (1), and a coupling portion (22) of a head member (2). The joining mechanism is constructed so that an inner cylindrical portion (22*b*) is pressed in a first coupling section (11*a*), an annular bead (2*a*) formed on an outer cylindrical portion (22*a*) squeezes a second coupling section (11*b*), and a bead (2*c*) formed on a step (22*c*) is pressed against the front end surface (1*a*) of the first coupling section when an annular ridge (1*b*) formed on the second coupling section (11*b*) is fitted in an annular groove (2*b*) formed in the outer cylindrical portion (22*a*). A ball holding tube (7) is provided with a ball housing bore (7*b*) and a connecting bore (7*d*) formed so that a low step is formed between the ball housing bore and the connecting bore. The edge of the tip of the ball holding tube is rounded. A head member is provided with a spring support portion (2*f*) for supporting a coil spring (8), provided with slots (2*g*). A cap releasing member (9) for releasing a cap (5) put on a head portion(222) of a barrel assembly (E) has operating portions disposed on the side surface of the cap so as to be in contact with an inclined portion (2*h*) of the head member.

8 Claims, 4 Drawing Sheets

ERASING LIQUID PEN

TECHNICAL FIELD

The present invention relates to a correction pen having the shape of a writing instrument, comprising a flexible barrel, a correction fluid prepared by dispersing a covering material such as white titanium pigment in an organic solvent and contained in the barrel, and a correction tip attached to the barrel, and capable of oozing out the correction fluid through the correction tip when the barrel is compressed between fingertips, and of being carried in a clothing pocket or the like.

BACKGROUND ART

Correction instruments which apply a white correction fluid to a paper sheet have been used to cover up incorrectly written marks. Recently, correction instruments respectively using color correction fluids of different colors have been marketed and used for marking as well as for writing. Demand for such correction instruments has greatly increased with the expansion of the application field. A correction instrument in an early stage of development was a simple bottle-type desktop correction instrument having a bottle containing a correction fluid therein, and a stick incorporated into the cap and provided at its free end with a brush. Such a simple bottle-type desktop correction instrument has been replaced with a squeeze correction instrument having a flexible container containing a correction fluid, a head cap for closing the container, and an application tip, capable of discharging the correction fluid through the application tip when the container is squeezed between fingertips, free from the possibility of spilling the correction fluid even if the container is laid sideways and capable of preventing the correction fluid from solidification even if the container is left uncapped. Recently various inventions and devices have been proposed to prevent the drying of the correction fluid on the application tip to avoid troublesome work for removing the solidified correction fluid from the inside of the cap and the application tip every time the squeeze correction instrument is used.

As shown in FIG. 6, a correction instrument according to a previously proposed device disclosed in JP-U No. 62-29103 has a barrel assembly E comprising a flexible barrel 1 having a fluid tank portion 111 and a reduced front portion 11 of a diameter smaller than that of the fluid tank portion 111, having an open front end, a correction fluid 3 contained in the barrel 1, a stirring member 4 contained in the barrel 1, a head member 2 having a coupling portion 22 fitted on the front portion 11 of the barrel 1, an application tip 66 serving as a front end portion of the head member 2 and as a component of a valve mechanism, a coil spring 8 resiliently biasing the application tip 66 forward and an annular member 10 having a spring bearing portion 10*a*. The annular member 10 is provided with a center hole 10*c* of a size allowing the application tip 66 to slide therein and allowing the correction fluid 3 to flow therethrough and a flange 10*b* held between the front end surface 1*a* of the front portion 11 of the barrel 1 and a shoulder 22*c* formed in the head member 2. A cap 5 is detachably put on a head portion 222 of the barrel assembly E.

With the expansion of the field of use of correction instruments as mentioned above, there have been proposed various correction instruments employing a ball capable of drawing lines of a fixed width and of writing letters as an application tip. One of those previously proposed correction instruments is disclosed in JP-U No. 5-80791.

As shown in FIGS. 7A and 7B, a barrel assembly E included in a correction instrument disclosed in JP-U No. 5-80791 is assembled by putting a correction fluid 3 and a stirring member 4 in a barrel 1 having a fluid tank portion 111, and a reduced front end portion 11 of a diameter smaller than that of the fluid tank portion 111, having an open front end, putting a ball 6 in a ball holding tube 7 having an inside diameter slightly greater than the diameter of the ball 6 and having a front end 7*a* bent inward by swaging to keep the ball 6 therein, fitting the ball holding tube 7 in a front bore 2*d* formed in a head member 2, inserting a pressing member 88 in the ball holding tube 7 so that its front end is in contact with the ball 6, fitting an annular member 10 having a spring receiving portion 1*a* in a bore formed in the head member 2, extending a coil spring 8 between the back end of the pressing member 88 and the spring receiving portion 10*a* of the annular member 10 to apply a pressure to the pressing member 88 so that the ball 6 projects partly from the front end of the ball holding tube 7, and fixedly mounting a coupling portion 22 of the head member 2 on the front end portion 11 of the barrel 1. A cap 5 is detachably put on a head portion 222 of the barrel assembly E.

When using the prior art correction instrument according to the device disclosed in JP-U No. 62-29103, the pressure applied by fingertips to the flexible barrel is adjusted so that a desired quantity of the correction fluid is discharged through the application tip. When putting the cap of the correction instrument disclosed in JP-U No. 7-24470 on the body portion of the barrel assembly, air contained in the cap is compressed, and the compressed air flows into the barrel to maintain the interior of the barrel at an elevated pressure. When the application tip is pressed against a paper sheet or the like, the correction fluid is discharged automatically. Such, in outline, is the course of development of the correction instrument. The prior art correction instruments, practically, have both advantages and disadvantages, and there is still room for improvement in their performance and function.

Although it is difficult to provide a correction instrument capable of exercising performance and function meeting all the requirements of the user, the present invention is intended to provide a correction pen having the shape of a writing instrument capable similarly to writing instruments, of being carried in a clothing pocket, and incorporating therein improvements in the airtightness and strength of the joint of a barrel and a head member, in performance to secure smoothness in discharging a fluid and correction work, and in function to enable a cap to be removed from the barrel quickly and easily.

The barrel and the head member are joined together in an airtight fashion because the correction fluid contains an organic solvent. Most conventional correction instruments employ a joint structure like that shown in FIG. 6 or in FIGS. 7A and 7B in which the flange lob of the annular member 10 is held between the front end surface 1*a* of the barrel and the shoulder 22*c* of the coupling portion of the head member or employ an elastic packing to seal the joint. In view of the strength of the joint of the barrel and the head member, it is usual to use a screw joint by joining together the threaded front end portion of the barrel and the threaded coupling portion of the head member. However, a sufficiently strong screw joint cannot be formed if the barrel is formed by blow molding and, when the strength of the screw joint is particularly important, an adhesive must be used in combination with the screw joint, which requires troublesome work. Furthermore, the round screw joint of the barrel and the head member imposes restrictions on design.

In a correction instrument employing a ball as an application medium, and a ball holder having, similarly to the tip of a ball-point pen, a ball seat in a ball housing bore, such as disclosed in JP-U No. 7-24470, a space around the ball is liable to be clogged with the fluid. If the correction instrument has a barrel which can be compressed to discharge the fluid forcibly to clean the tip, the correction instrument is able to be quickly restored to its normal condition. If the correction instrument is of a type which maintains the interior of the barrel at an elevated pressure to discharge the fluid automatically, it takes time to restore the clogged correction instrument to its normal condition, and hence special consideration is required to put the cap in an airtight condition on the head member of the barrel assembly. A front end portion of the ball holding tube has a small wall thickness, the feel of the contact with a paper sheet is deteriorated, and the correction fluid cannot be uniformly applied to marks to be erased if a ball of a small diameter is used to draw a narrow line by a correction instrument like the correction instrument proposed in JP-U No. 5-80791 shown in FIGS. 7A and 7B, in which the ball lies behind the front edge of the ball holding tube.

To prevent the correction fluid from drying on the tip, the grasping force of the cap put on the head portion of the barrel assembly is higher than that of the cap of an ordinary writing instrument, and hence considerable force must be applied to the cap when putting the cap on and removing the same from the head portion of the barrel assembly. Therefore, it often occurs that the cap is put incompletely on the head portion of the barrel assembly and that the cap cannot be pulled properly and requires an unpleasant operation to pry the cap off the head portion of the barrel assembly. The correction pen of the present invention is provided with a clip on its cap and is intended to be carried in a pocket of clothes and hence the cap must be further firmly put on the head portion.

SUMMARY OF THE INVENTION

The present invention has been made in view of the foregoing circumstances. Means for solving the foregoing problems and the best mode for carrying out the same will be described hereinafter, based on the premise that a barrel assembly is assembled by constructing a tip assembly by putting a ball in a ball holding tube having a front end bent inward by swaging to hold the ball therein and pressing the ball forward directly or through a pressing member by a coil spring so that the ball projects partly from the front end of the ball holding tube, disposing the tip assembly in a front bore formed in a head member, and joining a coupling portion of the head member to a front end portion of a flexible barrel containing a correction fluid and stirring members, and a correction pen is completed by putting a cap on the head portion of the barrel assembly.

To improve the airtightness and the strength of the joint of the barrel of the barrel assembly and the head member, the barrel has a fluid tank portion, a cylindrical first coupling section having an open front end, and a second coupling section having a circular cross section of a diameter greater than that of the first coupling section and smaller than that of the fluid tank portion or an elliptical cross section, extending between the fluid tank portion and the first coupling section, and provided with an annular ridge on its outer circumference. The coupling portion of the head member has an outer cylindrical portion to be fitted on the second coupling section of the barrel, having an inner circumference complementary to the outer circumference of the second coupling section, and is provided with an annular groove complementary to the annular ridge of the second coupling section of the barrel and an annular bead formed on the front side of the annular groove, having a diameter smaller than the outside diameter of the second coupling section and protruding toward the axis of the barrel. The coupling portion of the head member also has an inner cylindrical portion to be pressed in the first coupling section, having an outside diameter greater than the inside diameter of the first coupling section, and an annular bead formed in a step at the joint of the outer cylindrical portion and the inner cylindrical portion. A predetermined gap is formed between the back end surface of the head member and a shoulder of the barrel. The annular bead of the outer cylindrical portion of the head member squeezes the second coupling section of the barrel, and the front end surface of the first coupling section of the barrel is pressed against a bead formed at a stepped part of the head member when the head member is jointed to the barrel with the annular ridge of the second coupling section of the barrel fitted in the annular groove of the outer cylindrical portion of the head member.

The annular bead of the outer cylindrical portion of the head member engages firmly around the second coupling section to prevent the radial play of the head member and the barrel relative to each other. The front end surface of the first coupling section of the barrel is pressed against the bead formed at the stepped part of the head member to prevent the head member from axial movement relative to the barrel. Accordingly, the joint is highly strong, is not subject to loosening, and is kept in a satisfactory airtight state even if an external force is applied violently thereto.

To improve the mode of discharge of the correction fluid when correcting incorrectly written marks, writing letters or drawing lines, and to improve the feel of touch of the correction pen to the paper sheet or the like, the ball holding tube holding the ball, i.e., an application medium, is provided with a ball housing bore having a diameter slightly greater than that of the ball and extending from the front end of the ball holding tube in a length sufficient to enable the ball to be housed completely therein, a back bore, and a connecting bore having a diameter slightly smaller than that of the ball and connecting the ball housing bore to the back bore. The edge of the front end is rounded by barrel grinding after putting the ball in the ball housing bore and the front end of the ball holding tube is bent inward by swaging, and/or a spring support portion is formed in the interior of the inner cylindrical portion of the head member to support the coil spring extended in the tip assembly and is provided with slots to pass the correction fluid through the spring support portion.

Thus, the space surrounding the ball is not clogged with the correction fluid because a small step is formed in the ball holding tube between the ball housing bore and the connecting bore. Since the correction fluid is able to flow through the spring support supporting the coil spring, the correction fluid can be discharged in smooth response to the fine adjustment of the compressive force applied to the barrel. Since the ball is able to withdraw into the ball housing bore during barrel polishing for rounding the edge of the front end of the ball holding tube, the contact between the ball and a grinding stone can be avoided and the edge of the front end of the ball holding tube can be properly rounded without deforming the ball, so that the ball holding tube slides smoothly on a paper sheet or the like when the correction pen is used.

To improve and enable quick and simple removal of the cap from the barrel assembly, the cap is provided in its side wall with cap releasing members which are pressed toward the axis of the cap so as to slide along slopes or steps formed in the head member of the barrel assembly to release the cap from the head member of the barrel assembly.

Thus, the cap need not be pulled to remove the same from the barrel assembly; the cap releasing members slide along the slopes or the steps when pressed toward the axis of the cap to release the cap firmly fitted on the head member quickly and easily.

As mentioned above, according to the present invention, the barrel assembly is constructed by joining the head member to the barrel, the barrel assembly comprises a small number of parts, has a simple construction, is capable of containing the correction fluid containing an organic solvent in a satisfactory airtight fashion, has the strong joint of the head member and the barrel, has the space surrounding the ball and is not subject to clogging, ensures the smooth flow of the correction fluid from the fluid tank portion to the tip and enables the correction fluid to be discharged according to the finely adjusted pressure applied to the barrel assembly. The tip slides smoothly on a paper sheet or the like when correcting incorrect marks, writing letters and drawing lines. The cap can be easily removed from the barrel assembly by one hand, the correction pen can be safely carried in a clothing pocket of clothes similarly to a writing instrument, and the correction pen gives the same writing feel as that given by a writing instrument and can be manufactured at low cost.

BEST MODE FOR CARRYING OUT THE INVENTION

Figure 1A:
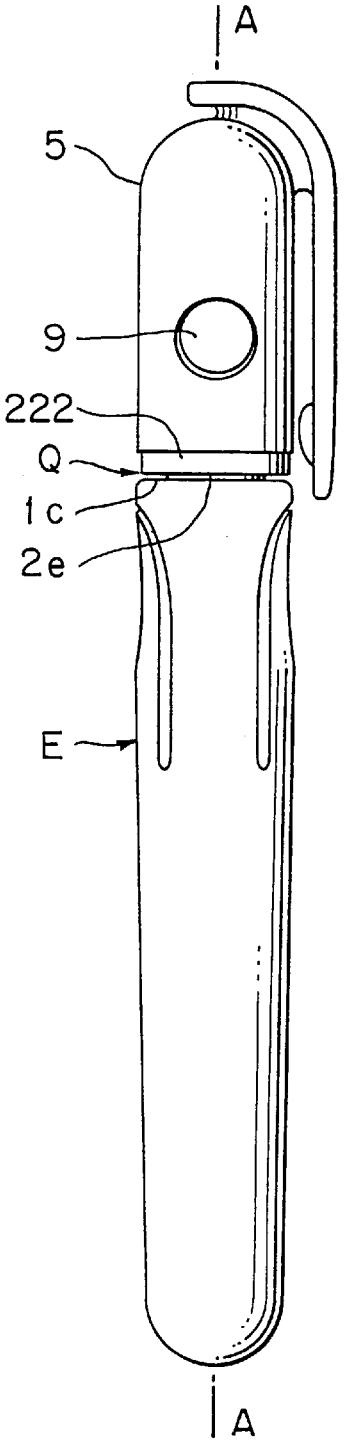
FIG. 1A is a side view of a correction pen in a preferred embodiment according to the present invention.

The best mode for carrying out the invention will be described hereinafter with reference to the accompanying drawings, in which parts and portions like or corresponding to those of the previously described prior art correction instruments are designated by the same reference characters.

Figure 1B:
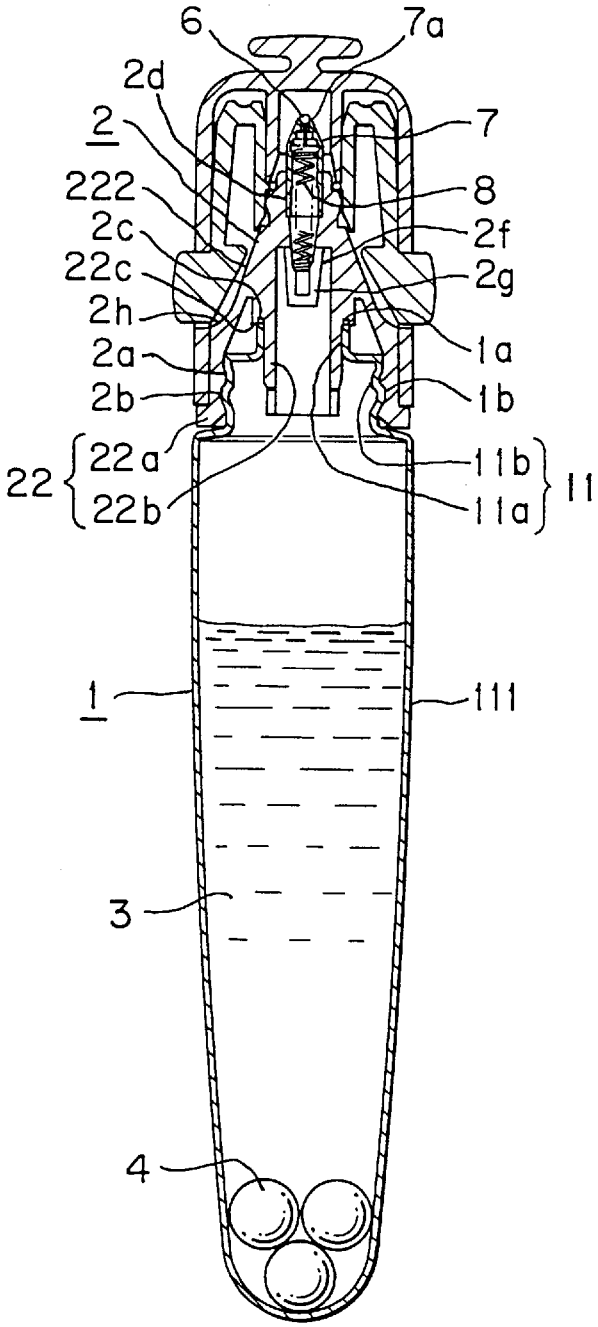
FIG. 1B is a longitudinal sectional view taken on line A—A in FIG. 1A.

FIG. 1A is a side view of a correction pen in a preferred embodiment according to the present invention and FIG. 1B is a longitudinal sectional view taken on line A—A in FIG. 1A. The correction pen embodying the present invention has a barrel assembly E constructed by joining together a front end portion 11 of a barrel 1 containing a correction fluid and stirring members 4, and a coupling portion 22 of a head member 2 holding in its front end bore 2*d* a ball holding tube 7 containing a ball 6, i.e., a tip assembly, and a coil spring 8 biasing the ball 6 toward the front end of the ball holding tube 7. A cap 5, provided in its side wall with a cap releasing member 9, is put on a head portion 222 of the barrel assembly E.

Figure 2A:
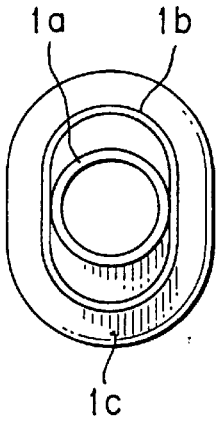
FIG. 2A is a top plan view of a barrel included in the correction pen embodying the present invention as viewed from the front side of the barrel.
Figure 2B:
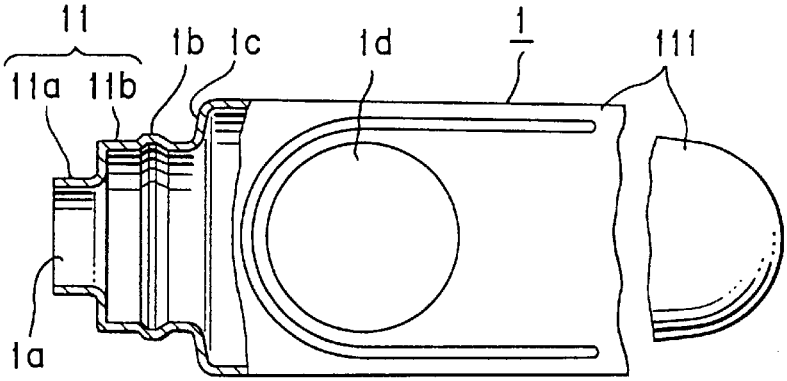
FIG. 2B is a fragmentary, partly sectional plan view of the barrel.

As shown in FIGS. 2A and 2B, the fluid tank portion 111 has an elliptic cross section. The fluid tank portion 111 may be formed in any desired shape. The fluid tank portion 111 is provided in its side wall with shallow recesses 1*d* and grooves around the shallow recesses id for the fine adjustment of pressure to be applied to the fluid tank portion 111. As shown in FIG. 2B, the front end portion 11 of the barrel 1 has a cylindrical first coupling section 11*a* having an open front end 1*a*, and a second coupling section 11*b* having an elliptic cross section of a size greater than that of the cross section of the first coupling section 11*a* and smaller than that of the cross section of the fluid tank portion 111. The second coupling section 11*b* is provided on its outer circumference with an annular ridge (engagement part) 1*b*. A shoulder 1*c* substantially perpendicular to the second coupling section 11*b* is at the joint of the front end portion 11 and the fluid tank portion 111. The barrel 1 is formed of a resin, such as nylon 6, by blow molding.

Figure 3A:
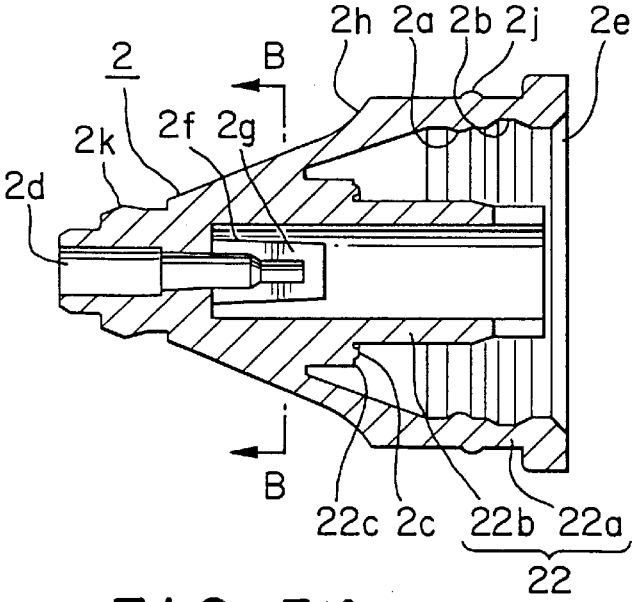
FIG. 3A is an enlarged longitudinal sectional view of a head member included in the correction pen embodying the present invention.
Figure 3B:
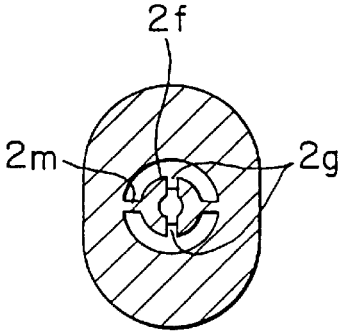
FIG. 3B is a sectional view taken on line B—B in FIG. 3A.

As shown in FIGS. 3A and 3B, the head member 2 is provided with a front end bore 2*d* to receive the ball holding tube 7 and has the coupling portion 22 having a back end opening surface 2*e*. The coupling portion 22 has an outer cylindrical portion 22*a* to be fitted on the second coupling section 11*b* of the barrel 1, having an inner circumference complementary to the outer circumference of the second coupling section 11*b*, and provided with an annular groove (engagement part) 2*b* complementary to the annular ridge 1*b* of the second coupling section 11*b* of the barrel 1 and an annular bead 2*a* formed on its inner circumference at a position on the front side of the annular groove having a diameter smaller than the outside diameter of the second coupling section 11*b* and protruding inward. The coupling portion 22 also has an inner cylindrical portion 22*b* to be pressed into the first coupling section 11*a* of the barrel 1, having an outside diameter greater than the inside diameter of the first coupling section 11*a*, and an annular bead 2*c* formed on a step 22*c* at the joint between the outer cylindrical portion 22*a* and the inner cylindrical portion 22*b*. A spring support portion 2*f* for supporting the coil spring 8, provided with a bore connected to the front end bore 2*d* is formed in the head member 2 so as to project into the interior of the inner cylindrical portion 22*b*. The spring support portion 2*f* is provided with axial slots 2*g* (FIG. 3B) facing the inner cylindrical portion 22*b* and communicating with the front end bore 2*d*. If the resilience of the coil spring 8 is relatively high and the strength of the spring support portion 2*f* is thought to be insufficient to withstand the resilience of the coil spring 8, the spring support portion 2*f* may be connected to the inner circumference of the inner cylindrical portion 22*b* by reinforcing ribs 2*m* (FIG. 3B).

The head member 2 is provided on its outer circumference with a front coupling portion 2*k*, a back coupling portion 2*j* and an inclined portion 2*h* along which the cap releasing member 9 of the cap 5 slides. The front coupling portion 2*k*, the back coupling portion 2*j* and the inclined portion 2*h* are the integral components of a cap holding and releasing means for holding the cap 5 on the head member 2 and releasing the same from the head member 2.

It is important to select an appropriate material, such as PBT (Polybutylene Terephthalate) resin, for forming the head member because the annular groove 2*b* and the annular bead 2*a* of the coupling portion 22 need to be forcibly removed from a mold when molding the head member 2 and to be shaped accurately, and the components of the cap holding and releasing means are formed on the outer circumference of the head member 2.

The present invention is intended to provide a pocketable correction pen capable of being carried, similarly to a writing instrument, in a clothing pocket, and the barrel 1 and the head member 2 must be firmly joined together so that the joint of the barrel 1 and the head member 2 may withstand unfavorable conditions which may be encountered by the correction pen. For example, it often occurs, when taking out a writing instrument from a breast pocket, that only the cap is taken out of the breast pocket and the barrel assembly remains in the breast pocket. In such a case the clothes will be smeared with ink if the writing instrument is a fountain pen or a marker that uses ink of a low viscosity. If things comes to the worst, cap cannot be properly put on the barrel assembly, the clip is broken or the joint of the barrel and the head member is broken. A crowded means of transportation is one of the causes of such trouble that may be readily thought of. Since the correction pen uses a correction fluid which is a special fluid containing an organic solvent, the reliability of the strength and airtightness of the joint of the barrel and the head member is an essential condition that should be satisfied.

Figure 4:
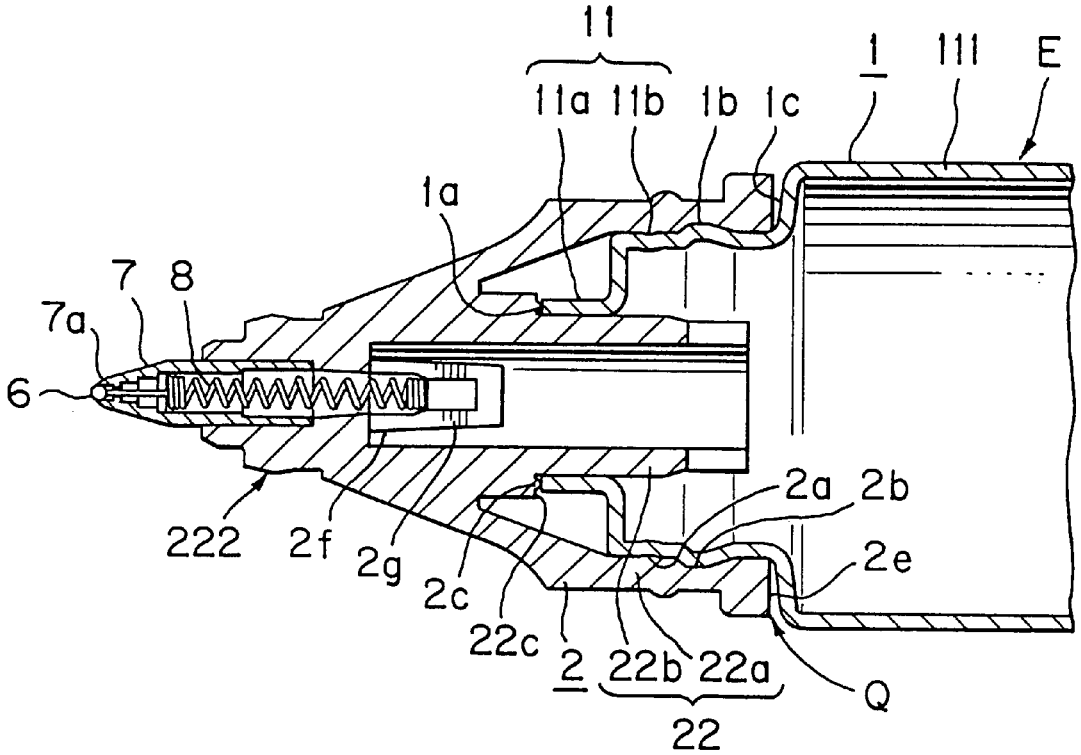
FIG. 4 is a fragmentary, enlarged longitudinal sectional view of the barrel and the head member included in the correction pen embodying the present invention.

The barrel 1 and the head member 2 of the correction pen embodying the present invention are joined together as shown in FIG. 4. Referring to FIG. 4, when the head member 2 is joined to the barrel 1 with the annular ridge 1*b* of the second coupling section 11*b* of the barrel 1 fitted in the annular groove 2*b* of the outer cylindrical portion 22*a* of the head member 2, a predetermined gap Q is formed between the back end surface 2*e* of the head member 2 and the shoulder 1*c* of the barrel 1, the inner cylindrical portion 22*b* of the head member 2 is fitted in the first coupling section 11*a* of the barrel 1, the annular bead 2*a* of the outer cylindrical portion 22*a* of the head member 2 squeezes the second coupling section 11*b* of the barrel 1 firmly, and the front end surface 1*a* of the first coupling section 11*a* of the barrel 1 is pressed against the bead 2*c* formed on the step 22*c* of the head member 2.

Since the joint of the barrel 1 and the head member 2 in the barrel assembly E is thus formed, the annular bead 2*a* of the outer cylindrical portion 22*a* of the head member 2 squeezes the second coupling section 11*b* of the barrel 1 firmly, and the barrel 1 and the head member 2 are restrained from radial play relative to each other. Since the front end surface 1*a* of the front end portion 11 of the barrel 11 is pressed against the bead 2*c* formed on the shoulder 22*c* of the head member 2, the barrel 1 and the head member 2 are restrained from axial play relative to each other. Since the gap Q is secured between the back end surface 2*e* of the head member 2 and the shoulder 1*c* of the barrel 1, any external force does not act on the front end portion 11 of the barrel 1 and the coupling portion 22 of the head member 2, even if a force is exerted violently on the front end portion 11 of the barrel 1 and the front end portion 11 is bent. Accordingly, the strong joint is not loosened and satisfactory airtightness of the joint is maintained. The size of the gap Q is dependent on the sizes and the shapes of the barrel 1 and the head member 2. If the back end surface 2*e* of the head member 2 is brought into contact with the shoulder 1*c* of the barrel 1 by an external force, the coupling portion 22 is prized by leverage, whereby the condition of the joint is deteriorated. Therefore, the size of the gap Q must be determined so that the head member 2 may not be brought into contact with the shoulder 1*c* of the barrel 1 even if an external force is exerted on the head member 2.

The prior art correction instrument employs the annular member having the flange held between the head member and the barrel, or the elastic packing to secure airtightness. However, any measures to prevent the radial and axial play of the head member and the barrel relative to each other are not incorporated therein, and therefore there is a possibility that the condition of the joint deteriorates with time to deteriorate the airtightness of the joint. The correction pen of the present invention secures the airtightness of the joint of the barrel 1 and the head member 2, without providing any member corresponding to the annular member or the packing between the barrel 1 and the head member 2, by a double-joint structure constructed by pressing the inner cylindrical portion 22*b* of the head member 2 in the first coupling section 11*a* of the barrel 1 formed of an elastic material, such as nylon 6, by a press fit, and squeezing the second coupling section 11*b* of the barrel 1 by the annular bead 2*a* of the outer cylindrical portion 22*a* of the head member 2. Thus, the correction pen has a relatively small number of parts and a simple construction.

Figure 5:
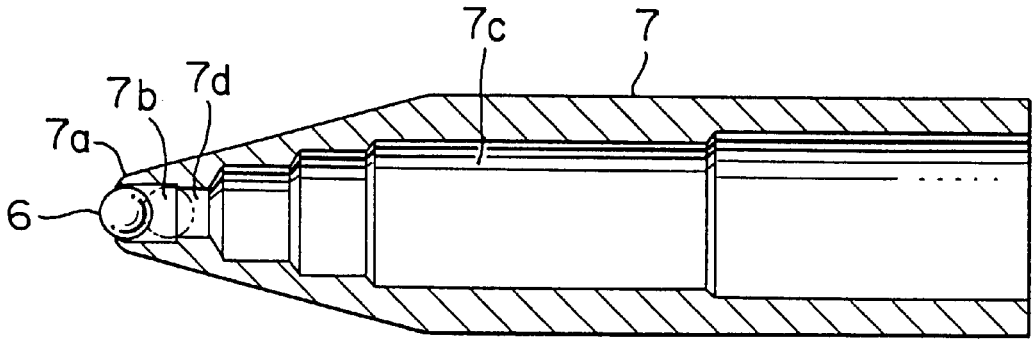
FIG. 5 is an enlarged longitudinal sectional view of a ball holding tube included in a tip assembly included in the correction pen embodying the present invention.
Figure 6:
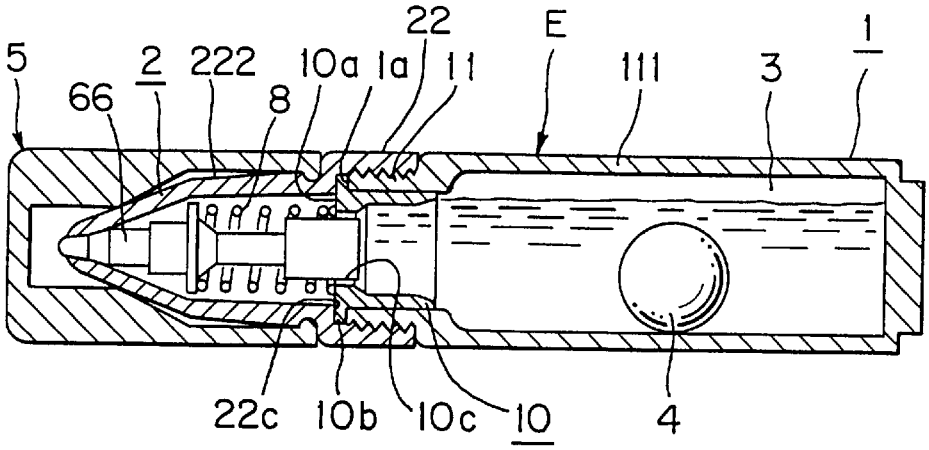
FIG. 6 (PRIOR ART)
FIG. 6 is a longitudinal sectional view of a prior art correction pen.
Figure 7A:
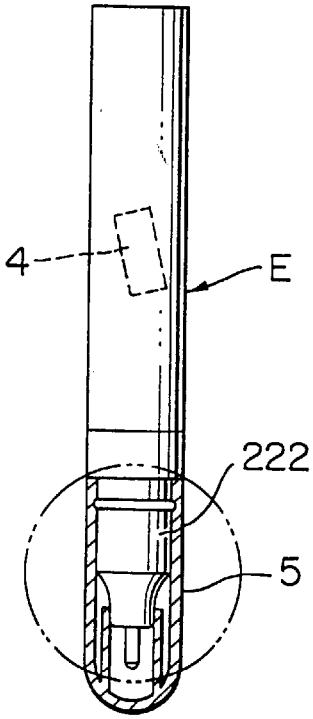
FIG. 7A (PRIOR ART)
FIG. 7A is a partly sectional side view of another prior art correction pen.
Figure 7B:
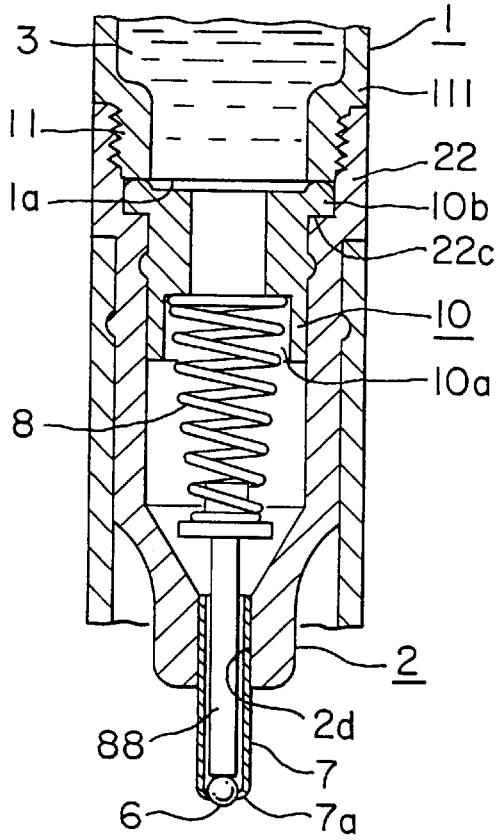
FIG. 7B (PRIOR ART)
FIG. 7B is a longitudinal sectional view of a front end portion of the correction pen of FIG. 7A.

The present invention employs the ball 6 as an application medium and incorporates improvements into the relation between the ball 6 and the ball holding tube 7 of the tip assembly fitted in the front end bore 2*d* of the head member, and the spring support portion 2*f* of the head member 2 supporting the coil spring 8. The ball holding tube 7 is fabricated by processing a metal rod. As shown in FIG. 5, a back bore 7*c* is formed in a back portion of the metal rod, a front portion of the metal rod is tapered toward the front end so that a front edge 7*a* has a predetermined wall thickness, a ball housing bore 7*b* of a length long enough to receive the ball 6 entirely therein and of a diameter slightly greater than that of the ball 6 is formed in the metal rod from the front end thereof backward, a connecting bore 7*d* of a diameter slightly smaller than that of the ball 6 is formed between the ball housing bore 7*b* and the back bore 7*c*, a ball 6 is put in the ball housing bore 7*b*, the front end of the metal rod is reduced by swaging, and then the edge 7*a* of the front end of the metal rod is rounded by barrel polishing.

Naturally, the ball holding tube 7 may be formed by processing a metal pipe. Essentially, the ball housing bore 7*b* and the connecting bore 7*d* are formed so that the step between the ball housing 7*b* and the connecting bore 7*d* is small to prevent the clogging of a space around the ball 6 due to the deposition of the pigment contained in the correction fluid 3 in the same space. Difficulty in handling the ball 6 individually during assembling work is avoided by combining the ball 6 and the ball holding tube 7, and measures are taken to prevent the deformation of the ball 6 by the grinding stone during barrel polishing for rounding the edge 7*a* of the front end of the ball holding tube 7. It is desirable to carry out the swaging process in two steps for swaging the front end in different swaging angles to round the edge 7*a* of the front end in an ideal shape. In this embodiment, the front end portion is swaged at a swaging angle of 80° first, and then the tip is swaged at a swaging angle of 120°, not shown, to make the user feel a smooth movement of the tip of the correction pen on a paper sheet or the like.

It is effective in preventing the drying of the fluid around the ball 6 to press the front end portion of the ball holding tube 7 against the ball 6 by supporting the ball 6 from behind at a predetermined position with a rod inserted through the back bore 7*c* in the ball housing bore 7*b* during the swaging process for swaging the front end of the ball holding tube 7 or to form the inner surface of the front end portion of the ball holding tube 7 in a shape, not shown, conforming to that of the ball 6 by hammering the ball 6 with a hammer rod inserted through the back bore 7*c* in the ball housing bore 7*b* after swaging the front end of the ball holding tube 7.

Although the rounding of the edge 7*a* of the front end of the ball holding tube 7 is important to enable the tip of the correction pen to slide smoothly on a paper sheet or the like, the correction pen will be useless unless the correction pen is able to discharge the correction fluid 3 smoothly. Therefore, it is important to secure the smooth flow of the correction fluid 3 from the barrel 1 into the tip assembly inserted in the front end bore 2*d* of the head member 2 by forming the ball housing bore 7*b* and the connecting bore 7*d* so that the step between the ball housing 7*b* and the connecting bore 7*d* is small to prevent the clogging of a space around the ball 6 and by forming the support portion 2*f* provided with the axial slots 2*g* (FIG. 3B), for supporting the coil spring 8 so as to project into the space surrounded by the inner cylindrical portion 22*b*.

Thus, the correction fluid 3 is able to flow naturally from the fluid tank portion 111 of the barrel 1 into the space surrounded by the inner cylindrical portion 22*b* of the head member 2 and further through the axial slots 2*g* of the spring support portion 2*f* supporting the coil spring 8 into the tip assembly When the correction pen is held with its tip assembly directed upward, the ball 6 is pressed against the inner surface of the front end portion having the edge 7*a* of the ball holding tube 7 by the coil spring 8 like a valve element pressed against a valve seat to close a valve, the fluid around the ball 6 remains around the ball 6 and all the fluid in the bore of the relatively large diameter in which capillarity is relatively low reverses into the fluid tank portion 111. Accordingly, it is important that the inner surface of the front end of the ball holding tube 7 is formed in a shape conforming to that of the ball 6 to prevent the fluid remaining around the ball 6 from drying, to discharge the fluid smoothly and to enable the tip of the correction pen to slide smoothly on a paper sheet or the like.

Furthermore, the correction pen of the present invention enables removal of the cap 5 quickly and easily from the head portion 222 of the barrel assembly E. FIGS. 1A and 1B illustrate the relation between the cap 5 and the cap releasing member 9 by way of example. The cap 5 is provided with an inside cap formed integrally with the top wall thereof so as to isolate the end part of the head portion 222 and the tip assembly from the atmosphere and to be fitted in a stationary portion of the cap releasing member 9 to hold the cap releasing member 9 in place. The cap 5 is provided in its side wall with openings disposed directly opposite to each other, and push buttons connected to the stationary portion of the cap releasing member 9 are projected outside through the openings. The cap 5 is provided at its open end portion with a holding part for holding the cap 5 on the head member 2. (Indication of parts other than principal parts by reference characters is omitted.)

When the cap 5 is put on the head portion 222 of the barrel assembly E, the stationary portion of the cap releasing member 9 and the front coupling portion 2*k* of the head member 2 are engaged firmly, and the holding part formed in the open end portion of the cap 5 and the back coupling portion 2*j* of the head member 2 are engaged firmly. Therefore, a considerably high force is necessary to pull off the barrel assembly E by holding the barrel assembly E and the head portion 222 and simply pulling, which is thus effective in preventing the separation of the barrel assembly E from the cap 5 in the pocket and the resultant smearing of clothes with the correction fluid. According to the present invention, the cap releasing member 9 has the push buttons projected outside through the openings formed in the cap 5 which slide along the inclined portion 2*h* of the head member 2 when pressed inward to release the cap 5 from the head member 2 of the barrel assembly E. Thus, the cap 5 firmly held on the head member 2 can be quickly and easily released from the head member 2.

The relation between the cap 5 and the cap releasing member 9 is not limited to that employed in the embodiment. For example, it is possible to form a step instead of the inclined portion 2*h* in the head member 2, and each of the push buttons of the cap releasing member 9 may be provided with an inclined surface, not shown, that slides along the step of the head member. A cap releasing member (not shown) may be formed integrally with the cap. Since the cap can be released from the head portion simply by pressing the push buttons of the cap releasing member projecting from the side surface of the cap, the cap can be removed from the barrel assembly by one hand and hence the other hand can be used for other purposes.

We claim:

1. A correction pen, comprising:

a pen barrel containing a correction fluid and a stirring member therein and having a fluid tank portion and a front end portion at a front end of said fluid tank portion;

said front end portion including a hollow first coupling section with an open front end having an annular front edge, and a hollow second coupling section formed between said first coupling section and said fluid tank portion, said second coupling section being greater in cross-sectional size than said first coupling section and being smaller in cross sectional size than said fluid tank portion, an annular shoulder being formed between said second coupling section and said fluid tank portion, and said second coupling section having a first annular engagement part on an outer surface thereof;

a head member having a rear coupling portion at a rear end thereof, said rear coupling portion comprising a hollow outer coupling portion tightly fitted on said second coupling section of said pen barrel and a hollow inner coupling portion tightly fitted in said first coupling section of said pen barrel, said outer coupling portion having a back end surface at rear end thereof and a second annular engagement part on an inner surface thereof, said second annular engagement part having a shape complementary to and being engaged with said first annular engagement part;

an annular bead provided within said head member between said outer coupling portion and said inner coupling portion, said annular front edge of said open front end of said first coupling section being in abutment against said annular bead;

said outer coupling portion being sized such that an annular gap is formed between said back end surface and said shoulder;

a pen tip attached to said head member; and a cap removably fitted on said head member to cover said pen tip.

2. The correction pen of claim 1, wherein said first engagement part comprises a ridge and said second engagement part comprises a groove.

3. The correction pen of claim 1, wherein said annular bead is formed on an annular step formed between said outer coupling portion and said inner coupling portion.

4. The correction pen of claim 1, wherein said pen tip comprises:

a ball holding tube fitted in said front end of said head member, said ball holding tube having a ball housing bore formed in a front end thereof, a back bore formed in a rear portion thereof, and a connecting bore connecting said ball housing bore and said back bore;

a ball fitted within said ball holding tube;

said ball holding tube having a reduced front end for retaining said ball within said ball housing bore; and said connecting bore being smaller than said ball.

5. The correction pen of claim 1, wherein:

said head member has a front end bore and said pen tip includes a ball housing tube fitted in said front end bore, and a ball fitted within a front end of said ball housing tube.

6. The correction pen of claim 5, and further comprising:

a spring support portion projecting rearward of said front end bore into said inner coupling portion; and a spring disposed within said ball housing tube and between said ball and said spring support portion to urge said ball forward.

7. The correction pen of claim 6, wherein said spring support portion has a slot through which the correction fluid can flow from within said pen barrel into said ball housing tube.

8. The correction pen of claim 1, wherein said cap comprises a cap releasing mechanism including:

an inclined portion provided on a front portion of said head member;

a cap releasing member provided on a side of said cap to be pressed by an operator and having an inside surface for acting on and sliding along said inclined portion when said cap releasing member is pressed so as to release said cap from said head member.

* * * * *